United States Patent [19]

Hey et al.

[11] 4,260,510

[45] Apr. 7, 1981

[54] CLEANING COMPOSITION

[75] Inventors: David G. Hey, Northwich; Robert W. Wheelhouse, Runcorn, both of England

[73] Assignee: Imperial Chemical Industries Limited, London, England

[21] Appl. No.: 86,671

[22] Filed: Oct. 19, 1979

[30] Foreign Application Priority Data

Oct. 23, 1978 [GB] United Kingdom ..... 41620/78
Jan. 19, 1979 [GB] United Kingdom ..... 01933/79

[51] Int. Cl.[3] ..... C11D 7/50; C11D 7/32; C11D 7/30; C23G 5/02

[52] U.S. Cl. ..... 252/171; 252/67; 252/69; 252/162; 252/172; 252/DIG. 8; 252/DIG. 9; 252/364; 134/38; 134/40

[58] Field of Search ..... 252/172, 171, 162, 67, 252/69, DIG. 8, DIG. 9, 364; 134/38, 40

[56] References Cited

U.S. PATENT DOCUMENTS

| | | | |
|---|---|---|---|
| 3,864,408 | 2/1975 | Beckers | 252/171 X |
| 3,903,009 | 9/1975 | Bauer et al. | 252/172 X |
| 4,062,794 | 12/1977 | Figiel | 252/DIG. 9 |

*Primary Examiner*—Mayer Weinblatt
*Attorney, Agent, or Firm*—Cushman, Darby & Cushman

[57] ABSTRACT

A composition suitable for cleaning printed circuit boards consists of 89.5% to 96.9% 1,1,2-trichloro-1,2,2-trifluoroethane, 2.5% to 8% ethanol, 0.1% to 3% methyl acetate and preferably 0.01% to 0.5% nitromethane.

11 Claims, No Drawings

CLEANING COMPOSITION

This invention relates to improved cleaning compositions comprising trichlorotrifluoroethane.

It is well known that azeotropic mixtures of solvents or mixtures approximating thereto can be employed as cleaning liquids especially for the removal of contaminants from synthetic organic polymers or plastic materials. Such mixtures often comprise 1,1,2-trichloro-1,2,2-trifluoroethane as a primary solvent and a cosolvent. The latter may be selected from a very large number of solvents including by way of example, methylene chloride, acetonitrile, methyl acetate, methylal, acetone, 1,1-dichloroethane, trans-dichloroethylene and lower aliphatic alcohols, for example, ethanol.

Much time and effort have been expended in attempts to obtain cleaning compositions having the desired characteristics. The chosen solvent mixtures may not however be satisfactory in that they are not capable of cleaning the article to a sufficiently high degree. For example they may be disadvantageous in that they are not able to remove the modern active resin-soldering fluxes sufficiently well and the treated material may not have a high degree of surface finish.

We now provide a cleaning composition comprising specific proportions of 1,1,2-trichloro-1,2,2-trifluoroethane, ethanol and methyl acetate which reduce the disadvantages associated with use of many other solvents.

According to the invention we provide a cleaning composition characterised in that it comprises 89.5% to 96.9% 1,1,2-trichloro-1,2,2-trifluoroethane, 2.5% to 8% ethanol and 0.1% to 3% methyl acetate, all percentages being by weight with reference to the total weight of the solvent mixture.

The composition preferably comprises 91% to 96.1% 1,1,2-trichloro-1,2,2-trifluoroethane, 2.5% to 6% ethanol and 1.4% to 3% methyl acetate. It is more preferred that the composition comprises 92.6% to 95.3% 1,1,2-trichloro-1,2,2-trifluoroethane, 3% to 4.7% ethanol and 1.7% to 2.7% methyl acetate. The composition containing approximately 94.2% 1,1,2-trichloro-1,2,2-trifluoroethane, 3.7% ethanol and 2.1% methyl acetate which behaves as an azeotrope is particularly preferred. When the latter mixture or mixtures approximating thereto are employed in conventional degreasing units the cleaning composition will vary a little but are usually within the above stated broad proportions. It is also preferred to incorporate in these preferred cleaning compositions a small amount of nitromethane, for example, at least 0.01% and up to 0.5% nitromethane. Often these cleaning compositions contain less than 0.1% nitromethane. A particularly useful composition is the aforesaid azeotropic mixture of 1,1,2-trichloro-1,2,2-trifluoroethane, ethanol and methyl acetate in which there is also incorporated approximately 0.05% nitromethane.

Other useful solvent compositions within the scope of the invention are those containing smaller proportions of methyl acetate and larger proportions of nitromethane than those described hereinbefore. These other compositions comprise 89.5% to 96.9% 1,1,2-trichloro-1,2,2-trifluoroethane, 2.5% to 8% ethanol, 0.1% to 1.4% methyl acetate and 0.5% to 1% nitromethane. More preferably the compositions within this range comprise 93.5% to 96.2% 1,1,2-trichloro-1,2,2-trifluoroethane, 3% to 4.7% ethanol, 0.2% to 0.9% methyl acetate and 0.6% to 0.9% nitromethane. The composition containing approximately 94.8% 1,1,2-trichloro-1,2,2-trifluoroethane, 3.8% ethanol, 0.6% methyl acetate and 0.8% nitromethane which behaves as an azeotrope is still more preferred.

The solvent mixtures may if desired contain small amounts of other adjuvants, for example, a small amount of surface active agent.

The cleaning compositions of the present invention may be used in conventional operating techniques. Preferably the composition is employed at the boil. The contaminated article may be immersed in the cleaning composition or jetted with a spray of the composition. Suitably also the article after treatment with the cleaning composition is rinsed with the same solvent composition containing 1,1,2-trichloro-1,2,2-trifluoroethane, alcohol, methyl acetate and nitromethane. Preferably the essentially azeotropic composition is employed. The compositions are useful in a wide range of cleaning applications. They are also useful in the removal of water from contaminated articles.

The present invention includes within its scope a process of incorporating ethyl alcohol methyl acetate and if desired nitromethane in the hereinbefore described proportions into 1,1,2-trichloro-1,2,2-trifluoroethane. The invention also includes within its scope a process of cleaning contaminated articles by contacting the contaminated articles with the present cleaning compositions.

The following Examples illustrate the invention.

EXAMPLE 1

Into a vacuum jacketed, twenty five plate, Oldershaw still were placed 300 mls 1,1,2-trichloro-1,2,2-trifluoroethane, 100 mls ethanol and 100 mls methyl acetate. The solvent mixture was heated at a high reflux ratio for six hours. Samples were taken from the top of the column, condensed and analysed by gas liquid chromatography.

The samples were found to be a constant boiling mixture (b.pt 44.8° C. at 766 mm Hg) consisting of 94.2% 1,1,2-trichloro-1,2,2-trifluoroethane, 3.7% ethanol and 2.1% methyl acetate.

EXAMPLE 2

A conventional, stainless steel degreasing unit was employed having a cleaning compartment and a rinsing compartment and a condenser running round the upper portion of the walls of the unit. The cleaning and rinsing compartments were both 25 cms long by 15 cms wide. Into the cleaning compartment there was placed to a depth of 10 cms a cleaning composition consisting approximately of 94.2% 1,1,2-trichloro-1,2,2-trifluoroethane, 3.7% ethanol, 2.1% methyl acetate and 0.05% nitromethane. Into the rinsing compartment a similar mixture was placed to a depth of 20 cms. The compositions in both compartments were heated to boiling, the vapours were condensed and the condensate fed to the rinsing compartment. There was an overflow of cleaning composition from rinsing to cleaning compartment.

Printed circuit boards (size 5 cms by 2 cms) having a substrate of epoxy resin glass mat and contaminated with a flux known as Fry's R8 were dipped for periods of from ½ minute to 1 minute both in the cleaning compartment and the rinsing compartment.

The treated boards were all found to be perfectly clean.

COMPARISONS

By way of comparison the above procedure was repeated but using the azeotropic mixture of 1,1,2-trichloro-1,2,2-trifluoroethane (87.5%) and methyl acetate (12.5%) as cleaning and rinse mixtures.

After treatment the boards were still found to have flux adhering to them.

By way of comparison also the procedure of Example 2 was repeated but with the azeotropic mixture of 1,1,2-trichloro-1,2,2-trifluoroethane (95.5%) and ethyl alcohol (4.5%). After treatment the boards were still not free from flux and they had a white powder adhering thereto.

EXAMPLE 3

Into a vacuum jacketed, twenty five plate, Oldershaw still were placed 300 mls 1,1,2-trichloro-1,2,2-trifluoroethane, 100 mls ethanol, 100 mls methyl acetate and 100 mls nitromethane. The solvent mixture was heated at high reflux ratio for six hours. Samples were taken from the top of the column, condensed and analysed by gas liquid chromatography.

The samples were found to be a constant boiling mixture (b.pt. 44.1° C. at 766 mm Hg) consisting of 94.8% 1,1,2-trichloro-1,2,2-trifluoroethane, 3.8% ethanol, 0.6% methyl acetate and 0.8% nitromethane.

EXAMPLE 4

A conventional, stainless steel degreasing unit was employed having a cleaning compartment and a rinsing compartment and a condenser running round the upper portion of the walls of the unit. The cleaning and rinsing compartments were both 25 cms long by 15 cms wide. Into the cleaning compartment there was placed to a depth of 10 cms a cleaning composition consisting approximately of 94.8% 1,1,2-trichloro-1,2,2-trifluoroethane, 3.8% ethanol, 0.6% methyl acetate and 0.8% nitromethane. Into the rinsing compartment a similar mixture was placed to a depth of 20 cms. The compositions in both compartments were heated to boiling, the vapours were condensed and the condensate fed to the rinsing compartment. There was an overflow of cleaning composition from rinsing to cleaning compartment.

Printed circuit boards (size 5 cms by 2 cms) having a substrate of epoxy resin glass mat and contaminated with a flux known as Fry's R8 were dipped for periods of from ½ minute to 1 minute both in the cleaning compartment and the rinsing compartment.

The treated boards were all found to be perfectly clean.

We claim:

1. A cleaning composition consisting essentially of 89.5% to 96.9% 1,1,2-trichloro-1,2,2-trifluoroethane, 2.5% to 8% ethanol, and 0.1% to 3% methyl acetate.

2. A cleaning composition as claimed in claim 1 consisting essentially of 91% to 96.1% 1,1,2-trichloro-1,2,2-trifluoroethane, 2.5% to 6% ethanol and 1.4% to 3% methyl acetate.

3. A cleaning composition as claimed in claim 2 consisting essentially of 92.6% to 95.3% 1,1,2-trichloro-1,2,2-trifluoroethane, 3% to 4.7% ethanol and 1.7% to 2.7% methyl acetate.

4. A cleaning composition as claimed in claim 2 consisting essentially of 94.2% 1,1,2-trichloro-1,2,2-trifluoroethane, 3.7% ethanol and 2.1% methyl acetate.

5. A cleaning composition as claimed in claim 1 in which there is also incorporated at least 0.01% and up to 0.5% nitromethane.

6. A cleaning composition as claimed in claim 5 in which there is also incorporated at least 0.01% but less than 0.1% nitromethane.

7. A cleaning composition as claimed in claim 4 in which there is also incorporated about 0.05% nitromethane.

8. A cleaning composition as claimed in claim 1 consisting essentially of 89.5% to 96.9% 1,1,2-trichloro-1,2,2-trifluoroethane, 2.5% to 8% ethanol, 0.1% to 0.4% methyl acetate and 0.05% to 1.4% nitromethane.

9. A cleaning composition as claimed in claim 8 consisting essentially of 93.5% to 94.2% 1,1,2-trichloro-1,2,2-trifluoroethane, 3% to 4.7% ethanol, 0.2% to 0.9% methyl acetate and 0.6% to 0.9% nitromethane.

10. A cleaning composition as claimed in claim 8 consisting essentially of 94.8% 1,1,2-trichloro-1,2,2-trifluoroethane, 3.8% ethanol, 0.6% methyl acetate and 0.8% nitromethane.

11. A method of cleaning contaminated articles by contacting the contaminated articles with a cleaning composition according to claim 1 or claim .

* * * * *